US008846167B2

(12) United States Patent
Kobayashi et al.

(10) Patent No.: US 8,846,167 B2
(45) Date of Patent: Sep. 30, 2014

(54) IMAGE TRANSFER SHEET

(71) Applicant: Fuji Xerox Co., Ltd., Tokyo (JP)

(72) Inventors: Tomoo Kobayashi, Kanagawa (JP); Tetsuro Kodera, Kanagawa (JP); Naoyuki Egusa, Kanagawa (JP); Kaoru Torikoshi, Kanagawa (JP); Shintaro Kikuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/863,885

(22) Filed: Apr. 16, 2013

(65) Prior Publication Data

US 2014/0134357 A1 May 15, 2014

(30) Foreign Application Priority Data

Nov. 9, 2012 (JP) ..... 2012-247619

(51) Int. Cl.
*B41M 5/50* (2006.01)

(52) U.S. Cl.
CPC ..... *B41M 5/504* (2013.01); *B41M 2205/36* (2013.01)
USPC ..... 428/32.39; 428/195.1

(58) Field of Classification Search
CPC ..... B41M 5/504; B41M 2205/36
USPC ..... 428/32.39, 195.1
See application file for complete search history.

(56) References Cited

U.S. PATENT DOCUMENTS

| | | | |
|---|---|---|---|
| 5,824,420 | A | 10/1998 | Dobashi et al. |
| 5,841,462 | A | 11/1998 | Matsuo et al. |
| 6,004,658 | A | 12/1999 | Owada et al. |

FOREIGN PATENT DOCUMENTS

| | | | |
|---|---|---|---|
| JP | 05-096871 | A | 4/1993 |
| JP | 06-247068 | A | 9/1994 |
| JP | 07-068812 | A | 3/1995 |
| JP | 08-142365 | A | 6/1996 |
| JP | 08-156302 | A | 6/1996 |
| JP | 09-314875 | A | 12/1997 |
| JP | 11-291646 | A | 10/1999 |
| JP | 11-334265 | A | 12/1999 |
| JP | 3068284 | B2 | 7/2000 |
| JP | 2001-092255 | A | 4/2001 |
| JP | 3306558 | B2 | 7/2002 |
| JP | 2010-128061 | A | 6/2010 |
| JP | 4565608 | B2 | 10/2010 |

*Primary Examiner* — Bruce H Hess

(74) *Attorney, Agent, or Firm* — Sughrue Mion, PLLC

(57) ABSTRACT

An image transfer sheet includes an image-receiving layer, a substrate, and a rear outermost layer containing an alkali metal salt of an aliphatic carboxylic acid. The image-receiving layer, the substrate, and the rear outermost layer are arranged in that order.

3 Claims, 3 Drawing Sheets

IMAGE TRANSFER SHEET

CROSS-REFERENCE TO RELATED APPLICATIONS

This application is based on and claims priority under 35 USC 119 from Japanese Patent Application No. 2012-247619 filed Nov. 9, 2012.

BACKGROUND (i) Technical Field

The present invention relates to an image transfer sheet.

(ii) Related Art

Development of the image forming technology in recent years has lead to emergence of various types of printing methods, such as intaglio printing, relief printing, planographic printing, gravure printing, and screen printing, that are capable of massively producing images at lower cost without degrading the quality of the images. These printing methods are frequently used in producing information recording media, such as IC cards, magnetic cards, optical cards, and cards with any of these combinations, that store preliminarily determined data and that are capable of communicating with external devices in a contact or noncontact manner.

The mainstream image forming method for printing personal data for individuals, such as personal identification data (facial portrait, name, address, birth date, and various licenses) is an image forming method that uses a dye sublimation printer that uses ink ribbons or the like or a fusion thermal transfer printer.

In contrast, an electrophotographic image forming (printing) method includes charging a surface of an image-bearing member, exposing the surface of the image-bearing member in accordance to an image signal to form an electrostatic latent image by the potential difference between exposed portions and unexposed portions, and electrostatically developing the latent image with a color powder (image-forming material) called toner that has a polarity opposite to (or the same as) the potential of charging so as to form a visible image (toner image) on the surface of the image-bearing member. In the cases where a color image is to be formed, either this process is repeated several times or plural image forming devices are arranged side-by-side to form color visible images and these color visible images are transferred and fixed to an image recording member (immobilization: melting the color powder mainly by heat and solidifying the color powder by cooling).

SUMMARY

According to an aspect of the present invention, an image transfer sheet includes an image-receiving layer, a substrate, and a rear outermost layer containing an alkali metal salt of an aliphatic carboxylic acid. The image-receiving layer, the substrate, and the rear outermost layer are arranged in that order.

This aspect of the present invention provides an image-transfer sheet that helps suppress multi-feeding in an image-forming apparatus compared to when the rear outermost layer does not contain an alkali metal salt of an aliphatic carboxylic acid.

BRIEF DESCRIPTION OF THE DRAWINGS

Exemplary embodiments of the present invention will be described in detail based on the following figures, wherein.

DETAILED DESCRIPTION

Figure 1:
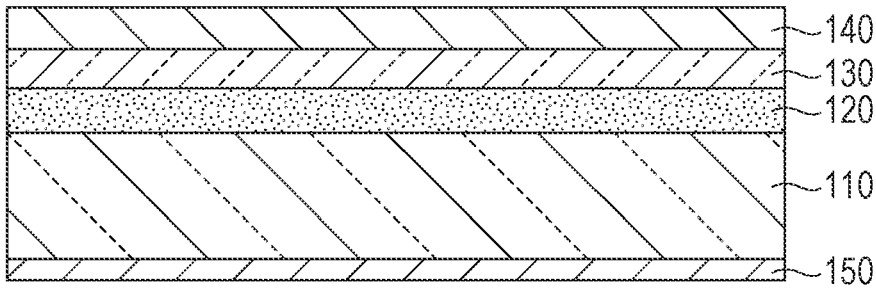
FIG. 1 is a cross-sectional view showing an example of an image transfer sheet according to an exemplary embodiment.

Exemplary embodiments of the present invention will now be described in detail.

Image Transfer Sheet

An image transfer sheet (hereinafter may be simply referred to as "transfer sheet") according to an exemplary embodiment includes an image-receiving layer, a substrate, and a rear outermost layer arranged in that order. The rear outermost layer contains an alkali metal salt of an aliphatic carboxylic acid.

Transfer sheets have been used in producing image recording members such as IC cards. For example, an image recording member has been produced by electrophotographically forming an image on a surface of an image-receiving layer which constitutes a part of a transfer sheet, superposing the transfer sheet onto an image support, thermocompression-bonding the transfer sheet onto the image support, and separating the substrate so as to transfer onto the image support either the image formed and the image-receiving layer or the image formed, the image-receiving layer, and a transparent support.

Recently, abnormal weather is a concern worldwide. In Japan also, dozens of locations record twenty or more extremely hot days over 35° C. in the summer. Moreover, the average daily humidity is sometimes 70% or higher. There is also a concern of power shortage during the summer due to, for example, the aftermath of the big earthquake and many general offices and plants impose power restrictions. Under these circumstances, image transfer sheets used in copy machines and printers are also desired to withstand high-temperature, high-humidity conditions.

However, when image transfer sheets of related art are loaded in an image-forming apparatus, a receiving layer of a transfer sheet adheres to a rear outermost layer of an adjacent transfer sheet. This increases the friction coefficient of the two sheets and sometimes results in a phenomenon called "multi-feeding", namely, simultaneous feeding of two or more transfer sheets superposed on one another. The increase in friction coefficient may also result in a phenomenon called "feed delay", namely, failure for transfer sheets to pass a designated place in the image-forming apparatus within a designated scheduled time.

The incidence of multi-feeding and feed delay tends to increase with the temperature and the humidity.

In contrast, multi-feeding in the image forming apparatus is effectively suppressed with a transfer sheet of the exemplary embodiment. The feed delay is also effectively suppressed. This is probably due to the following reason.

In the related art, softening of a resin contained in an image-receiving layer of a transfer sheet or bleed-out caused by migration of a substance contained in the image-receiving layer have caused changes in adhesiveness between the image-receiving layer and the rear outermost layer facing each other in the stack of transfer sheets. Probably, the friction coefficient between the stacked transfer sheets increases and the multi-feeding and the feed delay occurs as a result of these changes.

In contrast, a transfer sheet of the exemplary embodiment containing a metal salt of an aliphatic carboxylic acid in the rear outermost layer maintains lubricity. Thus, the change in adhesiveness between the rear outermost layer and the image-receiving layer from the adhesiveness at room temperature (for example, at 22° C. and 50% RH) is suppressed and thus the multi-feeding and feed delay are suppressed.

The layers that configurate the transfer sheet of the exemplary embodiment will now be individually described in detail.

The layer configuration of the transfer sheet of the exemplary embodiment may be any configuration that includes an image-receiving layer, a substrate, and a rear outermost layer. For example, the layer configuration may include an image-receiving layer, a transparent support, a tacking layer, a substrate, and a rear outermost layer that are arranged in that order. In order to smoothly separate the substrate during transfer of the image-receiving layer and the transparent support of the transfer sheet onto an image support (a member that serves as a support after the image-receiving layer and the like are transferred from the transfer sheet in producing an image recording member using a transfer sheet), the tacking layer may be provided between the transparent support and the substrate. An adhesive layer may be provided between the image-receiving layer and the transparent support.

Another example of the layer configuration of the transfer sheet includes an image-receiving layer, a releasing layer, a substrate, and a rear outermost layer arranged in that order. This layer configuration is not particularly limited as long as the image-receiving layer is smoothly separable from the releasing layer.

Examples of the configuration of the transfer sheet according to the exemplary embodiment will now be described in detail with reference to the drawings. Note that the configuration of the image transfer sheet of this exemplary embodiment is not limited to the configurations described below.

FIG. 1 is a schematic cross-sectional view showing an example of an image transfer sheet of the exemplary embodiment. The image transfer sheet shown in FIG. 1 includes a rear outermost layer 150, a substrate 110, a tacking layer 120, a transparent support 130, and an image-receiving layer 140 stacked in that order.

In the transfer sheet shown in FIG. 1, the peel strength between the transparent support 130 and the substrate 110 may be lower than the peel strength between the image-receiving layer 140 and the transparent support 130 and the peel strength between the substrate 110 and the rear outermost layer 150. When an attempt is made to tear a transfer sheet having this structure by pulling an end of a layer on one surface (front surface) and an end of a layer on the other surface (rear surface) of the transfer sheet away from each other, the transparent support 130 comes apart from the substrate 110.

Specifically, the tacking layer 120 is provided in the region sandwiched by the transparent support 130 and the substrate 110 as shown in FIG. 1. According to this structure, the peel strength between the transparent support 130 and the tacking layer 120 may be smaller than the peel strength between the image-receiving layer 140 and the transparent support 130 and the peel strength between the tacking layer 120 and the substrate 110. In other words, when an attempt is made to tear a transfer sheet by pulling an end of a layer on one surface (front surface) and an end of a layer on the other surface (rear surface) of the transfer sheet away from each other, the image-receiving layer 140 and the transparent support 130 come apart from the tacking layer 120, the substrate 110, and the rear outermost layer 150.

Furthermore, at the interface where separation occurs, the layer constituting one surface and the layer constituting the other surface may be separated from each other without leaving part of one layer on the other layer.

Figure 2:
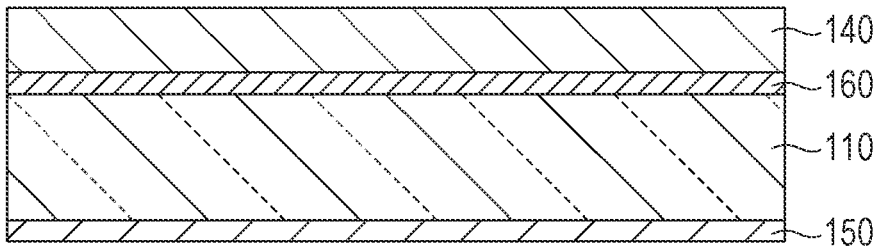
FIG. 2 is a cross-sectional view showing another example of an image transfer sheet according to an exemplary embodiment.

FIG. 2 is a schematic cross-sectional view showing another example of the image transfer sheet of the exemplary embodiment. The image transfer sheet illustrated in FIG. 2 includes a rear outermost layer 150, a substrate 110, a releasing layer 160, and an image-receiving layer 140 stacked in that order.

In the transfer sheet illustrated in FIG. 2, the peel strength between the image-receiving layer 140 and the substrate 110 may be smaller than the peel strength between the substrate 110 and the rear outermost layer 150. According to this structure, when an attempt is made to tear the transfer sheet by pulling an end of a layer on one surface (front surface) and an end of a layer on the other surface (rear surface) of the transfer sheet away from each other, the image-receiving layer 140 comes apart from the substrate 110.

In particular, as illustrated in FIG. 2, the releasing layer 160 may be provided in the region sandwiched by the image-receiving layer 140 and the substrate 110. In this structure, the peel strength between the image-receiving layer 140 and the releasing layer 160 may be smaller than the peel strength between the releasing layer 160 and the substrate 110. In other words, when an attempt is made to tear the transfer sheet by pulling an end of a layer on one surface (front surface) and an end of a layer on the other surface (rear surface) of the transfer sheet away from each other, the image-receiving layer 140 comes apart from the releasing layer 160, the substrate 110, and the rear outermost layer 150.

Furthermore, at the interface where separation occurs, the layer constituting one surface and the layer constituting the other surface may be separated from each other without leaving part of one layer on the other layer.

The peel strength (N/cm) at each of the interfaces of the layers constituting the transfer sheet is measured by the method below.

First, a sample prepared by cutting the transfer sheet to have a width of 25 mm is prepared. The sample is torn by pulling an end of a layer on one surface and an end of a layer on the other surface away from each other. Separation occurs at the interface at which the peel strength is the lowest.

In accordance with the method described above, 6 mm of the interface at which the peel strength is the smallest is separated, the separated ends are each held by a chuck or a clamp of a tensile tester, and the peel strength (N/cm) at a peel angle of 180 degrees is measured by setting the tensile rate to 300 mm/min. The measurement is conducted in accordance with Japanese Industrial Standard (JIS) X6305.

The sample is split into two parts by completing peeling at the interface having the smallest peel strength. For example, if the transfer sheet illustrated in FIG. 1 is peeled at the interface between the transparent support 130 and the tacking layer 120, the sample is divided into a sample part having the rear outermost layer 150, the substrate 110, and the tacking layer 120 and a sample part having the image-receiving layer 140 and the transparent support 130.

Then an attempt is made to further tear one of the sample parts by pulling an end of a layer on one surface and an end of a layer on the other surface (for example, in a sample part that includes the image-receiving layer 140 and the transparent support 130, an end of the image-receiving layer 140 and an end of the transparent support 130) away from each other. If an interface at which separation occurs is found, that interface is peeled by 6 mm, each of the separated ends is held by a chuck or a clamp of a tensile tester, and the peel strength (N/cm) at a peel angle of 180 degrees is measured at a tensile rate of 300 mm/min.

The same attempt is made on the other sample part. If there is an interface at which separation occurs is found, the peel strength of that interface is measured.

However, for the transfer sheet illustrated in FIG. 1, the interface between the rear outermost layer 150 and the substrate 110, the interface between the substrate 110 and the tacking layer 120, and the interface between the transparent support 130 and the image-receiving layer 140 may be bonded so as not to easily cause separation. Accordingly, the peel strength of the interface at which separation does not occur is assumed to be larger than the peel strength observed at the interface in which the measurement by the aforementioned method is possible.

The structure of each layer of the transfer sheet of the exemplary embodiment will now be described in detail by using the structure illustrated in FIG. 1 as an example.

Rear Outermost Layer

The transfer sheet according to the exemplary embodiment contains an alkali metal salt of an aliphatic carboxylic acid (also referred to as "aliphatic carboxylate" hereinafter) in the rear outermost layer.

Alkali Metal Salt of Aliphatic Carboxylic Acid

The aliphatic carboxylate according to the exemplary embodiment may be a substance generally called "soap". An aliphatic carboxylate is prepared by reacting an aliphatic carboxylic acid (may be referred to as "aliphatic acid" hereinafter) with sodium hydroxide or potassium hydroxide through a saponification method or a neutralization method to obtain a sodium salt of an aliphatic acid or a potassium salt of the aliphatic acid. A sodium salt is relatively easy to dissolve in water but a potassium salt is easier to dissolve in water. When a carboxylic acid is reacted with a divalent cation such as calcium, magnesium, or zinc instead of a monovalent cation such as sodium or potassium, a water-insoluble "metal soap" having two aliphatic acid units is obtained as a result of the reaction. Metal soaps obtained as such may also be used as the aliphatic carboxylate in this exemplary embodiment. Appropriate selection may be made by considering the desired conditions of use and production process.

The aliphatic carboxylic acid (aliphatic acid) used in the exemplary embodiment preferably has 8 to 22 carbon atoms and more preferably has 12 to 18 carbon atoms.

Specific example thereof include saturated aliphatic acids such as caprylic acid having 8 carbon atoms, capric acid having 10 carbon atoms, lauric acid having 12 carbon atoms, a tridecyl acid having 13 carbon atoms, myristic acid having 14 carbon atoms, pentadecyl acid having 15 carbon atoms, palmitic acid having 16 carbon atoms, heptadecyl acid having 17 carbon atoms, stearic acid having 18 carbon atoms, and behenic acid having 22 carbon atoms. Examples of the unsaturated aliphatic acid include palmitoleic acid having 16 carbon atoms and oleic acid, vaccenic acid, linoleic acid, linolenic acid, eleostearic acid, and ricinoleic acid each having 18 carbon atoms. Among these aliphatic acids, lauric acid, palmitic acid, stearic acid, and oleic acid are particularly preferable.

The aliphatic carboxylate in the exemplary embodiment is preferably a sodium salt or a potassium salt of any of the aliphatic acids described above and more preferably a sodium salt from the viewpoint of industrial availability.

The aliphatic carboxylate content of the rear outermost layer is preferably 15% by mass or more and 60% by mass or less, more preferably 20% by mass or more and 50% by mass or less, and most preferably 25% by mass or more and 45% by mass or less.

At an aliphatic carboxylate content of 15% by mass or more, the multi-feeding is more effectively suppressed. At a content of 60% by mass or less, the desired surface resistivity is easily achieved, the lubricating performance becomes appropriate, and feed delay is more effectively suppressed.

Particles (Filler)

The rear outermost layer of the exemplary embodiment may further contain particles.

As mentioned above, the rear outermost layer of this exemplary embodiment contains an alkali metal salt of an aliphatic carboxylic acid (aliphatic carboxylate). When particles are also contained in the rear outermost layer, the particles contact pickup rollers that pick the image transfer sheets loaded in the image forming apparatus one-by-one and the frictional force is retained as a result. Thus, the decrease in friction coefficient caused by the aliphatic carboxylate is suppressed and the feed delay is more effectively suppressed.

For such a purpose, the average particle size of the particles may be 0.1 μm or more and 3 μm or less or about 0.1 μm or more and about 3 μm or less, and may be 1.2 times or more of the thickness of the rear outermost layer.

The particles contained in the rear outermost layer may be organic resin particles. The organic resin particles may be crosslinked acryl-based particles such as those composed of methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate.

While the rear outermost layer in this exemplary embodiment may contain an acryl-based polymeric resin that contains a quaternary ammonium salt in a side chain as described below, crosslinked acryl-based particles exhibit high compatibility with the acryl-based polymeric resin and exhibit high dispersibility.

Other examples of the particles include particles composed of homopolymers and copolymers obtained by polymerizing one or more monomers selected from styrenes such as styrene, vinyl styrene, and chlorostyrene; monoolefins such as ethylene, propylene, butylene, and isobutylene; vinyl esters such as vinyl acetate, vinyl propionate, vinyl benzoate, and vinyl butyrate; esters of α-unsaturated aliphatic monocarboxylic acids; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and diene-based monomers such as isoprene and 2-chlorobutadiene.

The particles may contain inorganic particles. Examples of the inorganic particles include mica, talc, silica, calcium carbonate, zinc white, halloysite clay, kaolin, basic magnesium carbonate, quartz powder, titanium dioxide, barium sulfate, calcium sulfate, and alumina.

The particles (filler) is typically spherical in shape but may have a plate shape, a needle shape, or an irregular shape.

The particle content of the rear outermost layer is preferably 0.5% by mass or more and 20% by mass or less, more preferably 1% by mass or more and 15% by mass or less, and most preferably 5% by mass or more and 10% by mass or less.

At a particle content of 0.5% by mass or more, the feed delay is more effectively suppressed. Since the particle content is 20% by mass or less, excessive addition of particles is avoided and the increase in cost is suppressed. Moreover, the friction coefficient between the rear outermost layer and the image-receiving layer facing each other between the stacked transfer sheets is suppressed from becoming excessively high and thus the multi-feeding is more effectively suppressed. The surface resistivity is also suppressed from becoming excessively high.

Resin

The resin used in the rear outermost layer in this exemplary embodiment may be any resin capable of homogeneously retaining the components described above. The resin may be a thermoplastic resin such as a styrene-based resin, an acryl-based resin, a polyester-based resin, a polyether-based resin, a vinyl acetate-based resin, or a polyvinyl butyral resin, for example.

These resins are basically insulators. In this exemplary embodiment, the substrate may also be composed of an insulator. In electrophotographically forming an image, an image-forming material is placed on an image transfer sheet from a photosensitive member, a primary transfer belt, or the like inside the apparatus by using electrostatic force. Based on this principle, the surface of the substrate may be semiconductive. The surface resistivity of the transfer sheet at room temperature (22° C.) is preferably $1\times10^{7}\Omega/\square$ or more and $1\times10^{18}\Omega/\square$ or less and more preferably $1\times10^{8}\Omega/\square$ or more and $1\times10^{12}\Omega/\square$ or less. Various conductive materials may be added to the rear outermost layer to adjust the resistivity of the surface.

Surfactants are often used as the conductive material. Examples of the surfactants include cationic surfactants such as polyamines, ammonium salts, sulfonium salts, phosphonium salts, and betaine amphoteric salts; anionic surfactants such as alkyl phosphate; and nonionic surfactants such as aliphatic acid esters. When a negatively chargeable toner is used in the electrophotography method, the surfactant used in combination may be a cationic surfactant having high interaction with the negatively charged toner among these surfactants.

Among the cationic surfactants, a quaternary ammonium salt may be used. A compound represented by general formula (I) below is preferred as the quaternary ammonium salt.

(I)

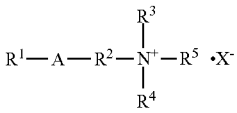

In the formula, $R^1$ represents an alkyl, alkenyl, or alkynyl group having 6 or more and 22 or less carbon atoms; $R^2$ represents a divalent group obtained by removing one hydrogen atom from a monovalent group selected from an alkyl group, an alkenyl group, and an alkynyl group each having 1 or more and 6 or less carbon atoms; and $R^3$, $R^4$, and $R^5$ may be the same as or different from one another and each represent an aliphatic group, an aromatic group, or a heterocyclic group. The aliphatic group refers to a linear, branched, or cyclic alkyl, alkenyl, or alkynyl group. The aromatic group refers to a monocyclic or fused polycyclic aryl group. These groups may each contain a substituent such as a hydroxyl group. A represents an amide bond, an ether bond, an ester bond, a divalent group obtained by removing one hydrogen atom from a phenyl group, or a single bond. $X^-$ represents a halogen atom, a sulfate ion, or a nitrate ion. The ion may contain a substituent.

Instead of the surfactant described above, an acryl-based copolymer that contains a quaternary ammonium salt represented by general formula (I) above is more preferably used in the rear outermost layer in the exemplary embodiment.

Surfactants have a lower molecular weight than acryl-based copolymers and may cause a phenomenon called bleed-out, which is migration of the surfactant toward the resin surface when the surfactant is used in combination with the resin. However, when an acryl-based copolymer that contains a quaternary ammonium salt in the side chain is used, the surface resistivity of the rear outermost layer is adjusted to be in a favorable range and bleed-out is effectively suppressed.

Examples of the acryl-based copolymer that contains a quaternary ammonium salt in the side chain include copolymers in which structural units represented by general formula (II) or (III), polyolefin structural units, (meth)acrylate structural units, and the like are linearly arranged.

(II)

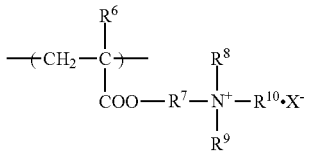

(III)

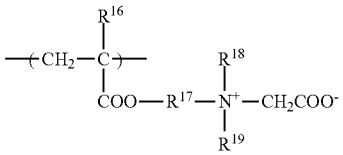

In the formulae, $R^6$ and $R^{16}$ each represent a hydrogen atom or a methyl group, $R^7$ and $R^{17}$ each represent an alkylene group having 1 to 4 carbon atoms, $R^8$, $R^9$, $R^{10}$, $R^{18}$, and $R^{19}$ may be the same as or different from one another and each represent a hydrogen atom or an alkyl group having 1 to 4 carbon atoms, and X represents a halogen atom, $CH_3OSO_3$ or $C_2H_5OSO_3$.

The structural units represented by general formula (II) or (III) may account for 10% by mass or more and 60% by mass or less of all copolymer components.

The number-average molecular weight of the acryl-based copolymer that contains a quaternary ammonium salt in the side chain may be 20000 or more and 100000 or less.

Image-Receiving Layer

Thermoplastic Resin

The image-receiving layer at the surface of the transfer sheet may contain a thermoplastic resin, for example. The thermoplastic resin may be any thermoplastic resin. Examples of the thermoplastic resin include homopolymers and copolymers obtained by polymerization of one or more monomers selected from styrenes such as styrene, vinyl styrene, and chlorostyrene; monoolefins such as ethylene, propylene, butylene, and isobutylene; vinyl esters such as vinyl acetate, vinyl propionate, vinyl benzoate, and vinyl butyrate; esters of α-unsaturated aliphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and diene-based monomers such as isoprene and 2-chlorobutadiene.

Of these, styrenes and esters of α-unsaturated aliphatic monocarboxylic acids may be used.

The thermoplastic resin used in the image-receiving layer of this exemplary embodiment may be a polyester-based resin since a polyester-based resin is used as the image-forming material. When the image-receiving layer contains the same type of resin as the image-forming material, the fixability of the image-forming material onto the surface of the transfer sheet is appropriately controlled.

The polyester-based resin may be a common polyester resin, a silicone-modified polyester resin, a urethane-modified polyester resin, or an acryl-modified polyester resin. These polyester resins may be used alone or in combination.

The polyester-based resin is prepared by reaction between a polyvalent hydroxy compound and a polybasic carboxylic acid or a reactive acid derivative thereof. Examples of the polyvalent hydroxy compound include diols such as ethylene glycol, diethylene glycol, triethylene glycol, 1,2-propylene glycol, 1,3-propylene glycol, neopentyl glycol, and 1,4-butanediol; bisphenol A alkylene oxide adducts such as hydrogenated bisphenol A, polyoxyethylenated bisphenol A, and polyoxypropylenated bisphenol A; and dihydric phenols such as other dihydric alcohols and bisphenol A.

Examples of the polybasic carboxylic acid include malonic acid, succinic acid, adipic acid, sebacic acid, alkylsuccinic acid, maleic acid, fumaric acid, mesaconic acid, citraconic acid, itaconic acid, glutaconic acid, cyclohexanedicarboxylic acid, phthalic acid (isophthalic acid and terephthalic acid), other divalent carboxylic acids, and reactive acid derivatives thereof such as acid anhydrides, alkyl esters, and acid halides.

In order to make the resulting thermoplastic resin nonlinear to a degree that does not generate tetrahydroxyfuran insolubles, a trivalent or higher valent polyhydroxyl compound or a trivalent or higher valent polybasic carboxylic acid may be added in addition to the divalent hydroxy compound and the carboxylic acid.

The thermoplastic resin content (solid ratio) in the image-receiving layer is preferably 60% by mass or more and 100% by mass or less and more preferably 75% by mass or more and 95% by mass or less.

Other Components

A curable resin such as a thermosetting resin, a photosetting resin, or an electron-beam-curable resin may be further contained as the resin in the image-receiving layer.

The image-receiving layer may also contain a releasing agent such as a natural or synthetic wax, a releasing resin, a reactive silicone compound, or a modified silicone oil.

Examples of the natural wax include carnauba wax, bee wax, montan wax, paraffin wax, and microcrystalline wax. Examples of the synthetic wax include low-molecular-weight polyethylene wax, low-molecular-weight oxidized polyethylene wax, low-molecular-weight polypropylene wax, low-molecular-weight oxidized polypropylene wax, higher aliphatic acid wax, higher aliphatic acid ester wax, and sasol wax. These may be used alone or as a mixture of two or more.

Examples of the releasing resin include silicone resin, fluorine resin, modified silicone resin, thermosetting silicone resin, and photosetting silicone resin. Examples of the modified silicone resin obtained by modifying silicone resin with various types of resin include polyester-modified silicone resin, urethane-modified silicone resin, acryl-modified silicone resin, polyimide-modified silicone resin, olefin-modified silicone resin, ether-modified silicone resin, alcohol-modified silicone resin, fluorine-modified silicone resin, amino-modified silicone resin, and mercapto-modified silicone resin.

In this exemplary embodiment, a reactive silane compound and a modified silicone oil may be blended as a releasing agent.

These waxes and releasing resins may be contained together in the form of particles but are preferably incorporated in a thermoplastic resin so that they are dispersed and mixed in the thermoplastic resin.

In this exemplary embodiment, the image-receiving layer may further contain a filler.

The filler used in this exemplary embodiment is not particularly limited. The filler may be organic resin particles. Examples of the organic resin particles include particles composed of homopolymers and copolymers obtained by polymerizing one or more monomers selected from styrenes such as styrene, vinyl styrene, and chlorostyrene; monoolefins such as ethylene, propylene, butylene, and isobutylene; vinyl esters such as vinyl acetate, vinyl propionate, vinyl benzoate, and vinyl butyrate; esters of α-unsaturated aliphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and diene-based monomers such as isoprene and 2-chlorobutadiene.

Of these, styrenes and esters of α-unsaturated aliphatic monocarboxylic acids are preferred. When these thermoplastic resins are used as a filler, a solvent that does not dissolve the resin may be used to conduct coating. The filler is more preferably fine particles of a thermosetting resin having a crosslinked structure obtained by adding a crosslinking agent or the like to any of these thermoplastic resin or any of the thermosetting resins, photosetting resins, and electron beam-curable resins described above.

The filler may be inorganic particles. Examples of the inorganic particles include mica, talc, silica, calcium carbonate, zinc white, halloysite clay, kaolin, basic magnesium carbonate, quartz powder, titanium dioxide, barium sulfate, calcium sulfate, and alumina.

The filler particles are typically spherical in shape but may have a plate shape, a needle shape, or an irregular shape.

The volume-average particle size of the filler may be 0.1 μm or more and 30 μm or less, and 1.2 times or more of the thickness of the image-receiving layer.

The mass ratio of the filler to the binder (resin component), mass of the filler:mass of the binder, in the image-receiving layer of the image transfer sheet is preferably in the range of 0.01:100 to 15:100 and more preferably in the range of 0.5:100 to 5:100.

Inorganic particles (for example, $SiO_2$, $Al_2O_3$, talc, or kaolin) and plastic beads (for example, beads of crosslinked PMMA, polycarbonate, polyethylene terephthalate, or polystyrene) may be used in combination as the filler.

Transparent Support

A transparent support used in the exemplary embodiment will now be described.

A representative example of the transparent support is a plastic film. The plastic film may be an optically transparent film used as an OHP film. Examples thereof include a polyacetate film, a cellulose triacetate film, a nylon film, a polyethylene terephthalate film, a polyethylene naphthalate film, a polycarbonate film, a polysulfone film, a polystyrene film, a polyphenylene sulfide film, a polyphenylene ether film, a cycloolefin film, a polypropylene film, a cellophane, and an acrylonitrile-butadiene-styrene (ABS) resin film. Among these, a polyethylene naphthalate film, a polyethylene terephthalate film, and a polyphenylene sulfide film are preferably used.

The transparent support used in the exemplary embodiment may be made by any method. For example, a coextrusion method, a bonding method, and other known method may be used.

According to a typical procedure, materials are co-extruded, longitudinally stretched between two or more rolls with different peripheral speeds to a desired thickness, and wound. In the case of forming a biaxially stretched film, the resulting film is directly introduced into a tenter and stretched in the transverse direction by 2.5 to 5 fold. The stretching temperature here may be in the range of 100° C. or more and 200° C. or less.

The biaxially stretched film obtained thereby is heat-treated if desired. The heat treatment may be carried out in the tenter. A film having a low shrinkage ratio is obtained by heat-treating the film while relaxing the film in the longitudinal and transversal directions. The transparent support is particularly preferably a biaxially stretched film.

Releasing Treatment

The substrate-side surface of the transparent support and the transparent-support-side surface of the substrate may be subjected to a releasing treatment.

A typical example of the releasing treatment is to conduct surface treatment with a material having a releasing property (releasing material). The releasing material is not particularly limited but may be a silicon-based material. A silicon-based material is composed of a condensate resin containing at least a silane-based composition or a mixed composition of this condensate resin and a colloidal silica dispersion. The releasing material may further contain an organic resin.

Examples of the silane-based composition include organic silicon compounds such as silane compounds, fluorine-containing silane compounds, and isocyanate silane compounds. These materials undergo a condensation reaction and form resin compositions.

Examples of the silane compounds include alkoxysilanes such as $Si(OCH_3)_4$, $CH_3Si(OCH_3)_3$, $HSi(OCH_3)_3$, $(CH_3)_2Si(OCH_3)_2$, $CH_3SiH(OCH_3)_2$, $C_6H_5Si(OCH_3)_3$, $Si(OC_2H_5)_4$, $CH_3Si(OC_2H_5)_3$, $(CH_3)_2Si(OC_2H_5)_2$, $H_2Si(OC_2H_5)_2$, $C_6H_5Si(OC_2H_5)_3$, $(CH_3)_2CHCH_2Si(OCH_3)_3$, $CH_3(CH_3)_{11}Si(OC_2H_5)_3$, $CH_3(CH_2)_{15}Si(OC_2H_5)_3$, and $CH_3(CH_2)_{17}Si(OC_2H_5)_3$; silazanes such as $(CH_3)_3SiNHSi(CH_3)_3$; special silylating agents such as $((CH_3)SiNH)_2CO$ and tert-$C_4H_9(CH_3)_2SiCl$; silane coupling agents; silane compounds such as $HSC_3H_6Si(OCH_3)_3$; and hydrolysates and partial condensates of these.

Examples of the silane coupling agent include vinylsilanes such as vinyltris(β-methoxyethoxy)silane, vinyltriethoxysilane, and vinyltrimethoxysilane; acrylsilanes such as γ-methacryloxypropyltrimethoxysilane; epoxysilanes such as β-(3,4-epoxycyclohexyl)ethyltrimethoxysilane and γ-glycidoxypropylmethyldiethoxysilane; and aminosilanes such as N-β-(aminoethyl)-γ-aminopropylmethyldimethoxysilane, γ-aminopropyltriethoxysilane, and N-phenyl-γ-aminopropyltrimethoxysilane.

Examples of the fluorine-containing silane compound include $CF_3(CH_2)_2Si(OCH_3)_3$, $C_6F_{23}C_2H_4Si(OCH_3)_3$, $C_7F_{15}CONH(CH_2)_3Si(OC_2H_5)_3$, $C_8F_{17}C_2H_4Si(OCH_3)_3$, $C_8F_{17}C_2H_4SiCH_3(OCH_3)_2$, $C_8F_{17}C_2H_4Si(ON{=}C(CH_3)(C_2H_5))_3$, $C_9F_{19}C_2H_4Si(OCH_3)_3$, $C_9F_{19}C_2H_4Si(NCO)_3$, $(NCO)_3SiC_2H_4C_6F_{12}C_2H_4Si(NCO)_3$, $C_9F_{19}C_2H_4Si(C_2H_5)(OCH_3)_2$, $(CH_3O)_3SiC_2H_4C_8F_{16}C_2H_4Si(OCH_3)_3$, $(CH_3O)_2(CH_3)SiC_9F_{18}C_2H_4Si(CH_3)(OCH_3)_2$, and hydrolysates and partial condensates of these.

Examples of the isocyanate silane compounds include $(CH_3)_3SiNCO$, $(CH_3)_2Si(NCO)_2$, $CH_3Si(NCO)_3$, vinylsilyltriisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$, and $(NCO)_3SiC_2H_4(NCO)_3$.

Examples of the condensate resin of the silane-based composition in the exemplary embodiment include curable silicone resins such as thermosetting (condensation type or addition type) and photosetting silicone resins. Specific examples thereof are as follows.

Examples of the condensation-type thermosetting silicone resin include a curable silicone resin synthesized by thermal condensation reaction of a polysiloxane, such as silanol-terminated polydimethylsiloxane, used as a base polymer and polymethylhydrogensiloxane or the like used as a crosslinking agent in the presence of an organic acid metal salt such as an organic tin catalyst or an amine; a curable silicone resin synthesized by reacting polydiorganosiloxane having at a terminal a reactive functional group such as a hydroxyl group or an alkoxy group; and a polysiloxane resin synthesized by condensation of a silanol obtained by hydrolysis of trifunctional or higher functional chlorosilane or a mixture of trifunctional or higher functional chlorosilane and a mono- or difunctional chlorosilane.

The condensation-type thermosetting resins are categorized according to their forms into a solution type and an emulsion type. Either of these is preferred.

Examples of the addition-type thermosetting silicone resins include a curable silicon resin synthesized by reacting and curing a polysiloxane containing a vinyl group such as polydimethylsiloxane used as a base polymer and polydimethylhydrogensiloxane as a crosslinking agent in the presence of a platinum catalyst.

The addition-type thermosetting resins are categorized according to their forms into a solvent type, an emulsion type, and a solventless type. All types are preferred.

Examples of the thermosetting silicone resins obtained by curing condensation-type or addition-type resins include pure silicone resin, silicone alkyd resin, silicone epoxy resin, silicone polyester resin, silicone acrylic resin, silicone phenolic resin, silicone urethane resin, and silicone melamine resin.

Examples of the photosetting silicone resin include curable silicone resin synthesized in the presence of a cationic photocatalyst and a curable silicone resin synthesized by utilizing a radical curing mechanism. A modified silicone resin obtained by a photocuring reaction between a low-molecular-weight polysiloxane having a hydroxyl group or an alkoxy group bonded to a silicon atom and an alkyd resin, a polyester resin, an epoxy resin, an acrylic resin, a phenolic resin, a polyurethane, a melamine resin, or the like may be used. Such resins may be used alone or in combination.

Substrate

Next, a substrate used in the exemplary embodiment is described.

The substrate is not particularly limited and may be a plastic film, for example. Examples of the plastic film include a polyacetate film, a cellulose triacetate film, a nylon film, a polyester film, a polycarbonate film, a polysulfone film, a polystyrene film, a polyphenylene sulfide film, a polyphenylene ether film, a cycloolefin film, a polypropylene film, a polyimide film, a cellophane, and an ABS resin film. The substrate may be opaque such as white in color.

The substrate may be a sheet such as a paper sheet, a metal sheet, a plastic sheet, or a ceramic sheet.

Tacking Layer

In the transfer sheet of the exemplary embodiment, a tacking layer may be provided between the transparent support and the substrate.

A tacking layer is a layer that has a function of an adhesive that physically holds the transparent support and the substrate together during the step of forming an image on the transfer sheet and the step of transferring the image onto an image support and a function of a releasing agent that causes separation of the transparent support during the image transfer step following the step of laminating and cooling the image.

The tacking layer may be composed of a material that is semi-solid (tacky) at room temperature and humidity (22° C., 50%) and is capable of joining other layers together without solidifying, thereby remaining semi-solid after joining. Alternatively, the tacking layer may be composed of a material that is solid (not tacky) at room temperature and humidity (22° C., 50%).

Examples of the material for the tacking layer include rubber such as natural rubber, styrene-butadiene rubber (SBR), and butyl rubber and synthetic resins such as acryl-based resins, silicone-based resins, and hot-melt resins. Here, a synthetic resin whose peel strength is adjustable by additives and the like is preferred and a silicone-based resin is more preferred from the viewpoints of stability over time, heat resistance, and the like. However, the choice of material for the tacking layer depends on the compatibility with the transparent support and thus is not limited to these.

Releasing Layer

In the transfer sheet of this exemplary embodiment, a releasing layer may be provided between the image-receiving layer and the substrate as illustrated in FIG. 2.

A releasing layer has a function of an adhesive that physically holds the transparent support and the substrate together during the step of forming an image on the transfer sheet and the step of transferring the image onto an image support and a function of a releasing agent that causes separation of the transparent support during the image transfer step following the step of laminating and cooling the image.

Examples of the material for the releasing layer are the same as those of the tacking layer.

Adhesive Layer

Although not shown in the drawing, an adhesive layer may be provided between the image-receiving layer and the transparent support in order to enhance the adhesiveness between the image-receiving layer and the transparent support and suppress separation of the transparent support from the image support prepared by using the transfer sheet.

The thickness of the adhesive layer is not particularly limited but is preferably in the range of 0.1 μm or more and 10 μm or less and more preferably in the range of 1 μm or more and 5 μm or less.

Physical Properties of Image-Transfer Sheet

The surface resistivities of a rear-outermost-layer-side surface and the image-receiving-layer side surface of the transfer sheet of this exemplary embodiment are preferably in the range of $1.0\times10^{8}\Omega$ or more and $3.2\times10^{13}\Omega$ or less and more preferably in the range of $1.0\times10^{9}\Omega$ or more and $1.0\times10^{12}\Omega$ or less.

The difference in surface resistivity between the two surfaces of the transfer sheet of the exemplary embodiment at 23° C. and 55% RH is preferably within the four digit order and more preferably within the three digit order.

The surface resistivity at 23° C. and 55% RH is measured in accordance to JIS K6911 by using circular electrodes (for example, "HR probe" of Hiresta IP produced by Mitsubishi Petrochemical Co., Ltd.).

A charge controlling agent may be added to the image-receiving layer to control the surface resistivity of the image-receiving layer to be in the range of $1.0\times10^{8}\Omega$ or more and $3.2\times10^{13}\Omega$ or less. A polymeric conductive agent, a surfactant, conductive metal oxide particles, and other suitable material may be used as the charge controlling agent.

A matting agent may be added to the image-receiving layer, the rear outermost layer, and whatever layer, other than the image-receiving layer, formed on a surface of the substrate.

Examples of the conductive metal oxide particles include ZnO, TiO, $TiO_2$, $SnO_2$, $Al_2O_3$, $In_2O_3$, SiO, $SiO_2$, MgO, BaO, and $MoO_3$. These may be used alone or in combination. The metal oxide more preferably further contains a foreign element. For example, ZnO may be doped with Al, In, or the like. TiO may be doped with Nb, Ta, or the like. $SnO_2$ may be doped with Sb, Nb, a halogen, or the like. Among these, $SnO_2$ doped with Sb is particularly preferable since it undergoes little change in conductivity over time and exhibits high stability.

Examples of the resin having lubricity used in the matting agent include polyolefins such as polyethylene and fluorine resins such as polyvinyl fluoride, polyvinylidene fluoride, and polytetrafluoroethylene (Teflon (registered trademark)).

Method for Producing Image Transfer Sheet

A method for producing an image transfer sheet will now be described by using the image transfer sheet according to one exemplary embodiment shown in FIG. 1 as an example. The image transfer sheet of the exemplary embodiment shown in FIG. 1 includes a rear outermost layer 150, a substrate 110, a tacking layer 120, a transparent support 130, and an image-receiving layer 140.

In this exemplary embodiment, a fixed image, which is a mirror image of a normal image to be formed on an image support by transfer, is formed on a surface of the transparent substrate 110 of the transfer sheet.

In order to prepare a transfer sheet having the tacking layer 120 according to this exemplary embodiment, a tackiness agent for forming the tacking layer 120 is applied to the surface of the substrate 110 and then the film that forms the transparent support 130 is attached thereto. A material for forming the rear outermost layer 150 is applied to a surface of the substrate 110 opposite to the surface where the transparent support 130 is formed and cured to form the rear outermost layer 150. A material that forms the image receiving layer 140 is applied to the surface of the transparent support 130 and cured to form the image receiving layer 140. Thus, a transfer sheet is formed.

Alternatively, the transfer sheet may be formed by applying a tackiness agent for forming the tacking layer 120 on one surface of the substrate 110 and applying a material for forming the rear outermost layer 150 to the other surface of the substrate 110, curing the applied tackiness agent and the material for forming the rear outermost layer 150, applying a material for forming the image receiving layer 140 to a surface of a film for forming the transparent support 130, and bonding the tacky-layer-120-side surface of the substrate 110 to the surface of the transparent support 130 opposite to the surface where the image receiving layer 140 is formed.

In order to form the image receiving layer 140, the components such as a wax, a resin, particles, and the like are mixed in an organic solvent, water, or the like and dispersed using ultrasonic waves, a wave rotor, an attritor, a sand mill, or the like to prepare a coating solution and the coating solution as prepared is applied to the surface of the transparent support 130.

Examples of the method used for application include a blade coating method, a wire bar coating method, a spray coating method, a dip coating method, a bead coating method, an air knife coating method, a curtain coating method, and a roll coating method.

In applying the materials to the surfaces of the substrate 110, the two surfaces may be worked simultaneously or one surface may be worked before the other.

The layers formed by applying materials (coating solutions) to the surfaces of the substrate 110 may be air-dried but are easier to be dried with heat. Examples of the drying method include common methods such as placing the layers in an oven, allowing the layers to pass through an oven, or having heating rollers to make contact with the layers.

For practical purposes, the coefficient of static friction of the transfer sheet surface is preferably 2 or less and more preferably 1 or less. The coefficient of kinetic friction of the transfer sheet surface is preferably in the range of 0.05 or more and 1 or less and more preferably in the range of 0.1 or more and 0.65 or less.

For example, in this exemplary embodiment, a toner image is formed on the surface of the image transfer sheet. In order to form a toner image, the toner image may be fixed to the surface by adjusting the temperature of the surface (image-forming surface) of the image transfer sheet to be equal to or higher than the fusing temperature of the toner. From the viewpoint of fusing temperature of typical toners, the surface temperature of the image transfer sheet is preferably 130° C. or less and more preferably 110° C. or less.

In this exemplary embodiment, a toner image formed by an electrophotographic image-forming apparatus is described as an image to be formed on the surface of the image transfer sheet. However, the image is not limited to the toner image. For example, an image may be formed by using an ink.

The thickness of the image-receiving layer 140 made as such is preferably in the range of 5 μm or more and 25 μm or less and more preferably in the range of 7 μm or more and 20 μm or less.

The thickness of the rear outermost layer may be within the range of the surface resistivity described above. For example, the thickness may be 0.01 μm or more and 0.3 μm or less.

Thickness of Image Transfer Sheet

The thickness of cards incorporating information chips such as IC chips is regulated to be no more than 840 μm (for example, refer to JIS X6301:2005) and any cards exceeding this thickness are nonstandard. However, the core of a card incorporating an information chip such as an IC chip already has a thickness of 760 μm. In order to transfer an image onto a surface of the core of this card by using a laminate film, the thickness of the layer to be transferred is to be 80 μm or less if the transfer is conducted on one side only and 40 μm or less if the transfer is conducted on both sides. Since the laminate film (transfer sheet) is to pass through an image forming apparatus such as an electrophotographic image forming apparatus and is to have a certain firmness, the laminate film may have a thickness of at least 75 μm.

From this viewpoint, the total thickness of the image-receiving layer and the transparent support of the transfer sheet of the exemplary embodiment may be 12 μm or more and 80 μm or less and the total thickness of the transfer sheet may be 75 μm or more and 135 μm or less.

When the total thickness of the image-receiving layer and the transparent support is limited to be 80 μm or less and the total thickness of the transfer sheet is 75 μm or more, the transfer sheet retains firmness that enables the transfer sheet to pass through the image forming apparatus. Since the total thickness of the transfer sheet is 135 μm or less, the transfer property of the image forming material such as a toner is satisfactorily retained and a high quality image is formed. Since the total thickness of the image-receiving layer and the transparent support is 12 μm or more, the image-receiving layer may be easily evenly formed on the transparent support and the area retained tends to be large.

The thickness of the layers described herein are determined by Digimatic Indicator ID-H0530 produced by Mitsutoyo Corporation.

Image Recording Member

Next, an image recording member made by using the image transfer sheet according to the exemplary embodiment described above is described.

Examples of the method for forming an image on a surface of the image-receiving layer of the transfer sheet of the exemplary embodiment other than the method for forming a toner image through an electrophotographic image forming method include a method for forming an ink image by using an ink and other known image-forming methods.

An image recording member of the exemplary embodiment is made by forming a mirror image with an image-forming material on an image-receiving-layer-side surface of the transfer sheet of the exemplary embodiment, superposing the image transfer sheet on an image support so that the image-carrying surface (surface on which the image is formed) of the image transfer sheet faces one side of the image support, and separating at least the substrate in the image transfer sheet from the image support so as to transfer the image-receiving layer and the transparent support of the image transfer sheet and the image formed with the image-forming material onto the image support. The image recording member at least includes the image support, the image-receiving layer, and the transparent support in that order and the image is formed in a region sandwiched by the image support and the image-receiving layer.

The image recording member is produced by a method that at least includes an image forming step of forming a mirror image with an image-forming material on an image-receiving-layer-side surface of the image transfer sheet, an alignment step of superposing the image transfer sheet on the image support so that the image-formed surface of the image transfer sheet faces one surface of the image support and to form an aligned stack, a thermocompression-bonding step of conducting thermocompression-bonding on the aligned stack, and a separation step of separating at least the substrate of the image transfer sheet from the image support after the image-forming material has been cooled and solidified so as to transfer at least the image-receiving layer and the transparent support of the image transfer sheet, and the image-forming material onto the image support to record the image.

Examples of the image recording member include (1) an image sheet or panel obtained by using an image transfer sheet of the exemplary embodiment having a surface on which a toner image indicating information is formed, the image sheet or panel being prepared by transferring that image onto an image support by thermocompression bonding; and (2) information recording media that store information and communicate with external devices in a contact or noncontact manner, such as an IC card, a magnetic card, an optical card, and a card of any combination of the foregoing, each medium at least including an information chip from which information is read through at least one of an electrical unit, a magnetic unit, and an optical unit, the information chip being disposed in the image support.

In the image recording member of (1) above, the toner image may be any toner image as long as some or all parts of the toner image indicate information that has a personal identification function irrespective of whether the toner image is image information or character information, for example, whether the toner image indicating the information is visually identifiable or not is not particularly limited. The toner image may be mechanically identifiable.

The image recording member (image recording medium) of (2) may be any member which includes an information chip carrying the information that has some identification function and from which the information is read through at least one unit selected from an electrical unit, a magnetic unit, and an optical unit. The information chip may be a read-only chip or a read-and-write (including overwriting) chip. Specific examples of the information chip are IC chips (semiconductor circuits).

Note that toner image formed on any of the above-mentioned information chips does not necessarily carry information having some identification function in all or some parts.

The information indicated in the toner image or stored in the information chip may be any information that is identifiable and may include variable information. Variable information means that image-recording members produced by the same standard or specifications may contain information different from one another.

For example, when a toner image contains variable information, the toner image that corresponds to the variable information may be a toner image that is different from one image recording member to another.

The variable information may contain personal information. For example, the image recording member (image recording medium) of this exemplary embodiment is applied to cash cards, employee ID cards, student ID cards, personal membership cards, residence cards, various driver licenses, and various certificates. When the image recording member is applied to any of these uses, the personal information may be, for example, a facial portrait, card holder verification image information, name, address, birth date, and any combination of these.

Formation of an image on a transfer sheet through the electrophotographic method described above will now be described. First, a surface of an electrophotographic photosensitive member (image-bearing member) is charged and is exposed according to image information so that an electrostatic latent image corresponding to the exposure is formed on the surface. Then a toner, which is an image-forming material, is supplied from a developing unit to the electrostatic latent image on the surface of the photosensitive member so as to visualize the electrostatic latent image with toner (formation of a toner image). Then the toner image is transferred onto an image-receiving-layer-side surface of the transfer sheet and fixed to the surface of the image-receiving-layer surface through heat or pressure. The transfer sheet is discharged from the electrophotographic apparatus.

In transferring an image, the transfer sheet of the exemplary embodiment is superposed on an image support having an IC chip or the like while having the image-carrying surface (the surface at which the image-receiving layer is formed) facing the image support. Accordingly, the image formed on the image-receiving layer of the transfer sheet is an inverted image (mirror image). In forming an electrostatic latent image on the surface of the photosensitive member, the image information used for exposure of the surface of the photosensitive member is the information used for forming a mirror image on the image-receiving layer.

The image support used in the exemplary embodiment may be composed of a metal, a plastic, a ceramic, or the like, and may have a sheet shape.

The image support used in the exemplary embodiment may be a plastic sheet and may be opaque so that the image formed on the image recording member is easily recognizable. A representative example of such a plastic sheet is a white plastic sheet.

Examples of the resin used to form the plastic sheet include those used in the substrate of the image transfer sheet. Specifically, a polyacetate film, a cellulose triacetate film, a nylon film, a polyethylene terephthalate film, a polyethylene naphthalate film, a polycarbonate film, a polystyrene film, a polyphenylene sulfide film, a polypropylene film, a polyimide film, a cellophane, an ABS resin film, a vinyl chloride sheet, an acryl sheet, or the like may be used.

Among these, a polyester film, in particular, a PETG film in which about half of the ethylene glycol component of polyethylene terephthalate is substituted with a 1,4-cyclohexanemethanol component, an alloyed resin prepared by blending a polycarbonate with polyethylene terephthalate, or an amorphous polyester called A-PET which is polyethylene terephthalate not biaxially stretched may be used.

In this exemplary embodiment, at least a surface of the image support onto which the image is transferred may contain PETG.

In the exemplary embodiment, in order not to use a chlorine-containing image support, the image support may be a polystyrene-based resin sheet, an ABS resin sheet, an acrylonitrile-styrene (AS) resin sheet, or a polyethylene terephthalate sheet or polyolefin-based resin sheet, such as polyethylene or polypropylene, to which a hot-melt adhesive such as a polyester or EVA is added.

A white plastic may be made by mixing a white pigment, such as metal oxide particles, e.g., silicon oxide, titanium oxide, or calcium oxide, an organic white pigment, polymer particles, or the like into a film. Alternatively, a surface of a plastic sheet may be sand-blasted or embossed to create irregularities on the surface of the plastic sheet so that the plastic sheet appears white by the light scattered at these irregularities.

The image support used in the exemplary embodiment is preferably a plastic sheet having a thickness in the range of 75 μm or more and 1000 μm or less and more preferably a PETG sheet having a thickness in the range of 100 μm or more and 750 μm or less.

In the exemplary embodiment, when an image recording member as a final product is used as an IC card or the like, an image support that includes a semiconductor circuit inside or on the surface is used as the image support.

In general, a method with which a sheet called an inlet to which the semiconductor circuit is fixed is sandwiched between sheet materials constituting the image support and the sheet and the sheet materials are hot-pressed to form an integral member by heat sealing may be used. Alternatively, a semiconductor circuit may be disposed between the sheet materials without using the inlet sheet and then the sheet materials may be heat-sealed into an integral member.

Alternatively, sheets constituting the image support may be bonded to one another with an adhesive such as a hot melt adhesive to make an image support having a semiconductor circuit inside. The method is not limited to these and for example, any method capable of forming a semiconductor circuit inside an IC card may be used as the method for forming the image support.

Depending on the use of the image recording member, the semiconductor circuit may be exposed in the surface of the image support instead of being embedded in the image support.

When the image recording member of the exemplary embodiment is used not only as an IC card but also as a magnetic card or the like, an antenna, a magnetic stripe, an external terminal, and other associated parts may be embedded in the image support. A magnetic stripe or a hologram may be printed on the image recording member or character information may be formed on the image recording member by embossing.

The transfer sheet and the image support may be superposed onto each other by manually holding the transfer sheet and the image support and aligning the edges of the transfer sheet and the image support. Alternatively, the transfer sheet and the image support may be sequentially discharged to a collating unit or the like and aligned after forming an image on the transfer sheet.

The press-bonding method used in the thermocompression bonding step is not particularly limited. Various known lamination techniques and lamination apparatuses may be employed. Among these, a heat press method of conducting lamination under heating may be employed. For example, press-bonding may be conducted through a typical lamination technique with a lamination apparatus. That is, a stack of a transfer sheet and an image support may be inserted through a nip part between a pair of heat rolls capable of heating so that the transfer sheet and the image support become thermally fused to a particular degree and heat-sealed.

After the image-forming material has been cooled and solidified, the substrate of the transfer sheet for electrophotography is separated from the image support to transfer the image-forming material onto the image support. As a result, an image recording member of the exemplary embodiment in which an image is recorded is formed.

The temperature at which the image-forming material is cooled and solidified is equal to or lower than the softening temperature and is the temperature at which the toner is sufficiently solidified. For example, the temperature may be equal to or lower than the glass transition temperature of the image-forming material and desirably in the range of room temperature (22° C.) to 50° C. The conditions under which the transfer sheet is separated from the image support are not particularly limited. The transfer sheet may be slowly separated from the image support while holding an end face of the transfer sheet.

Figure 3A:
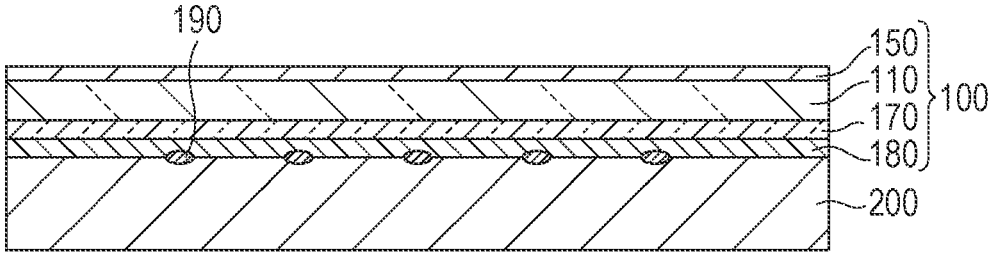
FIG. 3A is a cross-sectional view showing a stack according to an exemplary embodiment before thermocompression bonding.
Figure 3B:
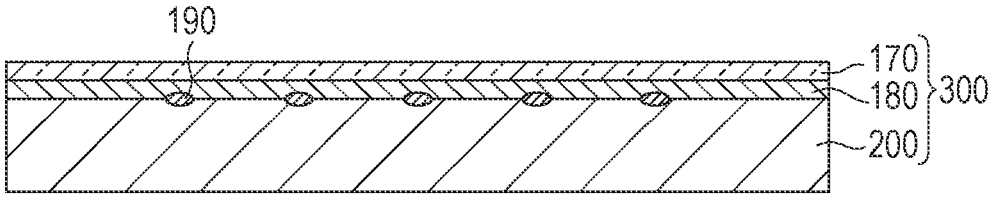
FIG. 3B is a cross-sectional view showing an image recording member according to an exemplary embodiment after thermocompression bonding.

A specific example of the image recording member described above will now be described with reference to the drawings. FIGS. 3A and 3B are cross-sectional views of the image recording member of the exemplary embodiment during production. FIG. 3A illustrates a state before thermocompression bonding and FIG. 3B illustrates an example of the image recording member after separation. In FIGS. 3A and 3B, reference numeral 100 denotes a transfer sheet, 200 denotes an image support, and 300 denotes an image recording member.

FIG. 3A illustrates a state in which a transfer sheet 100 and an image support 200 that receives the image to be transferred (for example, a PETG sheet) are stacked on each other to form a stack. Before thermocompression bonding, an image forming material (toner) 190 exists on an image-receiving-layer-180-side of the transfer sheet or at the interface between an image-receiving layer 180 and the image support 200.

Referring to FIG. 3B, after thermocompression bonding and separation, the image-forming material 190 is embedded in the surface of the image support 200 and the image-receiving layer 180. Accordingly, there is little difference in level between the surface of the image support 200 and parts where the image-forming material 190 are present. An image recording member 300 obtained thereby has the same feel as a printed image recording member and the image-forming material 190 does not easily come off.

After the separation, a transparent support 170 remaining on the image support 200 side serves as an overcoat layer of the image recording member 300.

The separated image recording member 300 may directly serve as an image recording member of the exemplary embodiment. When two or more images are formed on a transfer sheet for electrophotography, the sheet may be cut into pieces each having an image. As a result, a number of image recording members of a particular size are obtained.

Examples of forms of the image recording member of this exemplary embodiment include contact-type or noncontact-type information recording media that include personal information and/or image information, such as cash cards and employee ID cards with portrait pictures, student ID cards, personal membership cards, residence cards, various driver licenses, and various certificates, RFID tags, image sheets or image display panels for card holder verification used in medial setting, and display labels.

Production of Image Recording Member

Figure 4:
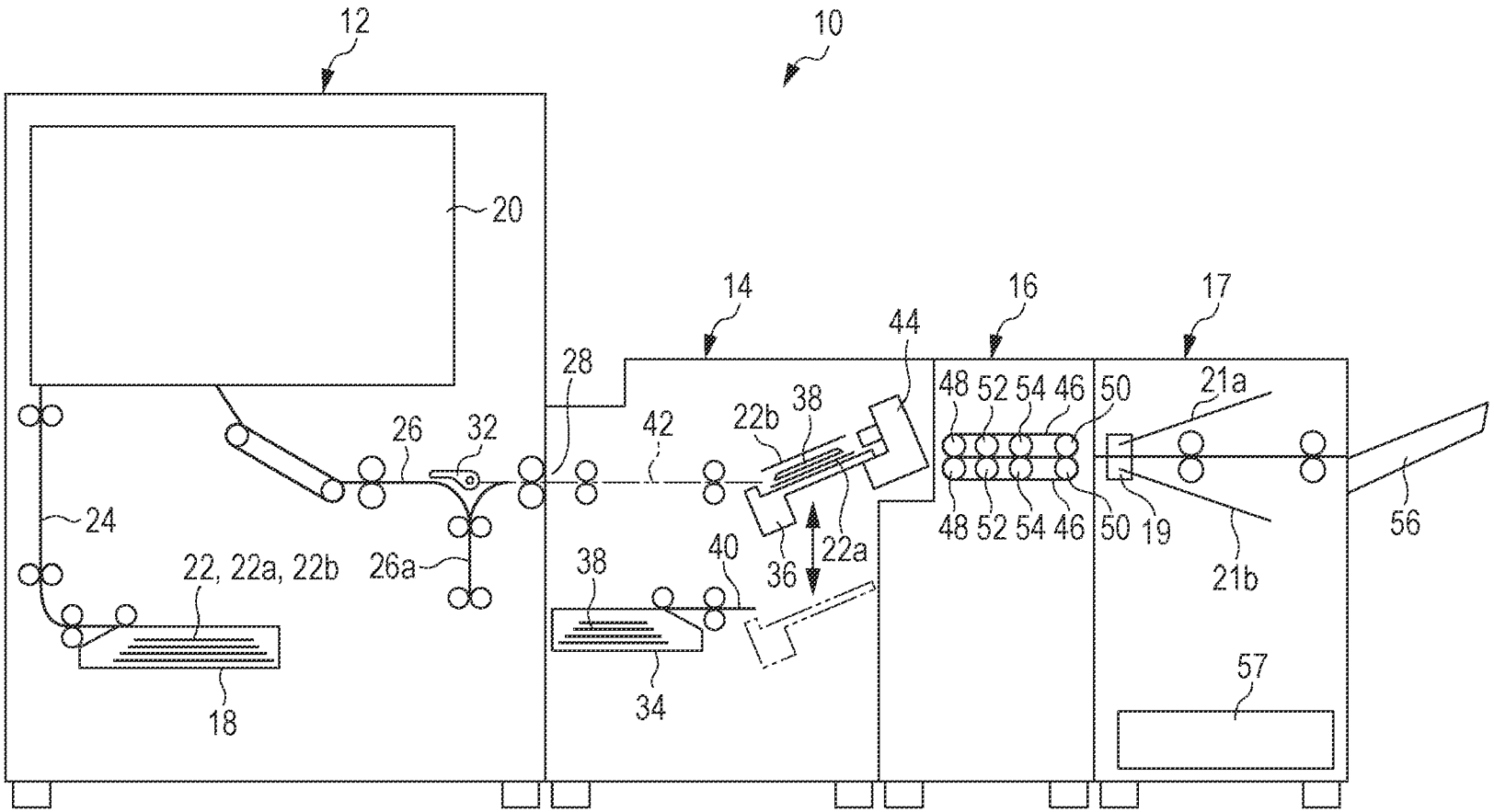
FIG. 4 is a schematic view showing an example of a structure of a system for producing an image recording member according to an exemplary embodiment.

Next, a method for producing an image recording member of the exemplary embodiment is described. FIG. 4 is a schematic diagram illustrating a system for producing the image recording member of the exemplary embodiment.

A system 10 for producing the image recording member in FIG. 4 includes an image-forming apparatus 12, a collating apparatus 14 (alignment apparatus), a lamination apparatus 16 (thermocompression-bonding apparatus), and a separation apparatus 17 (separation apparatus).

The image-forming apparatus 12 is constituted by, for example, a transfer sheet storage 18, an image-forming unit 20, a transport path 24 through which a transfer sheet 22 is transported from the transfer sheet storage 18 to the image-forming unit 20, and a transport path 26 through which the transfer sheet 22 is transported from the image-forming unit 20 to a discharge port 28. Other parts are omitted from the drawing.

Transfer sheets 22 are stored in the transfer sheet storage 18. The transfer sheet storage 18 is equipped with pickup rolls and feed rolls usually installed in typical sheet feeders. The feed rolls rotate at particular timings and transport the transfer sheet 22 to the image-forming unit 20.

The image-forming unit 20 has a typical structure of an electrophotographic device. Although not shown in the drawing, the image-forming unit 20 includes a latent image-bearing member, a charger that charges the latent image-bearing member, a latent image-forming device that forms a latent image on the charged latent image-bearing member, a developing device that forms a toner image by developing the latent image with a developer that at least contains a toner, a transfer device that transfers the developed toner image onto the transfer sheet 22, and a fixing device that fixes the transferred toner image onto the transfer sheet 22 through heating and pressing.

The transport paths 24 and 26 include roller pairs including driving roller pairs and guides (not shown). The transport path 26 further includes a reversing path 26*a* configured to reverse the transport direction of the transfer sheet 22 by 180°. A cum 32 that changes the guiding direction of the transfer sheet 22 is disposed at the branching portion between the transport path 26 and the reversing path 26*a*. The transfer sheet 22 is fed back and forth through the reversing path 26*a* and again fed to the transport path 26 so that the transport direction of the transfer sheet 22 is reversed by 180° with top side facing down.

The collating apparatus 14 includes a plastic sheet (image support) storage 34, a collating unit 36 (alignment unit), a transport path 40 through which a plastic sheet 38 (image support) is transported from the plastic sheet storage 34 to the collating unit 36, and a transport path 42 through which the transfer sheet 22 discharged from the discharge port 28 of the image-forming apparatus 12 is fed to the collating unit 36.

The transport path 40 through which the plastic sheet 38 is fed to the collating unit 36 and the transport path 42 through which the transfer sheet 22 is fed to the collating unit 36 are parallel to each other in the height direction.

The transport paths 40 and 42 may each be constituted by a plate-shape member and a transport rolls for transporting the transfer sheet 22 or the plastic sheet 38 on the surface of the plate-shape member. Alternatively, a belt-shaped transport member that is rotatable may be used. The transfer rolls or belts are rotated at times at which the transfer sheet 22 is discharged from the image-forming apparatus 12 or the plastic sheet 38 is discharged. As a result, the transfer sheet 22 or the plastic sheet 38 is transported to the collating unit 36.

The plastic sheet storage 34 (image support storage) stores plastic sheets 38 and is equipped with pickup rolls and feed rolls usually installed in typical sheet feeders. After the collating unit 36 has moved to the position of the discharge port of the plastic sheet storage 34, the feed rolls and the like are rotated to transport the plastic sheet 38 to the collating unit 36.

The collating unit 36 is, for example, connected to a belt outer wall having part of ends supported in the vertical direction (vertical direction in the drawing) and is configured to move up and down by the rotation of the belt so as to supply the plastic sheet 38 from the transport path 40 and the transfer sheet 22 from the transport path 42. Alternatively, any other known device for moving the collating unit 36 up and down may be employed such as a motor drive system. The collating unit 36 also includes an alignment unit (not shown) for aligning ends of the plastic sheet 38 and the transfer sheet 22 stacked.

The collating unit 36 also includes a provisional fastener 44 that provisionally holds together a stack constituted by two transfer sheets 22 and a plastic sheet 38 therebetween. The provisional fastener 44 is, for example, constituted by a pair of projecting pieces composed of a metal so as to be heated with a heater or the like. Ends of the stack are clamped with the pair of projecting pieces and are heat-sealed to achieve provisional fastening.

The heat sealing method employed in conducting provisional fastening is not limited to the method that uses a pair of projecting pieces. Any other known technique may be employed, such as having a heated needle-shaped member penetrate the stack in the sheet vertical direction or clamping the sheets with a member equipped with a ultrasonic vibrator so as to heat-bond the sheets by heat generated by ultrasonic vibrations. Alternatively, provisional fastening may be achieved through mechanically restricting the movements of the sheets without using heat. For example, the sheets may be fixed with staples, or a gripper that moves with the sheet along the transport path may be provided.

In the case where the provisional fastener 44 is installed on the transport path through which the stack is transported from the collating unit 36 to the lamination apparatus 16, the provisional fastener 44 is configured to come at an end of the collating unit 36 only at the time of conducting provisional fastening and to be moved from that transport path in other times.

The lamination apparatus 16 may employ, for example, a belt nip system configured by a pair of belts 46. Each belt 46 is supported by a heating and pressurizing roll 48 and a support roll 50 and pressure rolls 52 and 54 are provided between the rolls 48 and 50.

The press bonding method employed in the lamination apparatus 16 is not particularly limited and any known lamination technique and lamination device may be employed. For example, the stack may be passed through a nip portion between a pair of hot rolls so that the sheets constituting the stack are thermally fused and bonded to a particular degree. Alternatively, press bonding may be conducted through a common lamination technique with a common lamination device or through a thermal pressing technique with a thermal press device.

The separation apparatus 17 includes, for example, an air ejection nozzle 19 and guides 21*a* and 21*b*. A receiver 56 that holds the discharged sheets is disposed downstream of the transport path of the plastic sheet.

The operation of the system 10 for making an image recording member will now be described.

First, in the image-forming apparatus 12, a first transfer sheet 22*a* to be stacked on the rear side (lower side in the drawing) of a plastic sheet 38 is fed to the image-forming unit 20 from the transfer sheet storage 18 of the transfer sheets 22 through the transport path 24. After a toner image is transferred onto an upper surface (upper surface in the drawing) of the first transfer sheet 22*a* by electrophotography, the image is fixed to form a fixed image (image forming step). In this step, since a fixed image is formed on the upper surface of the first transfer sheet 22*a*, the first transfer sheet 22*a* is directly transported to the discharge port 28 through the transport path 26 and fed to the collating apparatus 14.

In the collating apparatus 14, the first transfer sheet 22*a* is fed to the collating unit 36 through the transport path 42 of the collating apparatus 14. The first transfer sheet 22*a* discharged from the transport path 42 has the image-carrying surface up and is fed to the collating unit 36 due to its own weight.

Next, the collating unit 36 is moved to the discharge port of the transport path 40 and the plastic sheet 38 is fed from the plastic sheet storage 34 through the transport path 40 to the collating unit 36. Here, the plastic sheet 38 discharged from the transport path 40 is fed to the collating unit 36 due to its own weight and lands on the first transfer sheet 22*a*.

Next, in the image-forming apparatus 12, a second transfer sheet 22*b* to be stacked on a surface (upper surface in the drawing) of the plastic sheet 38 is fed from the transfer sheet storage 18 through the transport path 24 to the image-forming unit 20. After a toner image is transferred onto the upper surface (upper surface in the drawing) of the second transfer sheet 22*b* by electrophotography, the toner image is fixed to form a fixed image (image forming step). Since the fixed image is formed on the upper surface of the second transfer sheet 22*b*, the second transfer sheet 22*b* passes through the transport path 26 and the reversing path 26*a*, returns to the transport path 26, transported to the discharge port 28, and fed to the collating apparatus 14.

During this step, the cum 32 is driven so that a tip thereof overlaps the transport path 26 at the branching portion between the transport path 26 and the reversing path 26*a*. The second transfer sheet 22*b* that has reached the position of the tip of the cum 32 has its transport direction changed, and guided and transported into the reversing path 26*a*. After the second transfer sheet 22*b* has reached the reversing path 26*a*, the driving rolls (not shown) are rotated in a reverse direction so that the second transfer sheet 22*b* travels back and forth in the reversing path 26*a* and then the second transfer sheet 22*b* is returned to the transport path 26. Accordingly, the second transfer sheet 22*b* that has returned to the transport path 26 has its transport direction reversed by 180° and has top-side facing down so that the second transfer sheet 22*b* is transported with the image-carrying surface facing downward (downward in the drawing).

In the collating apparatus 14, the second transfer sheet 22*b* is fed to the collating unit 36 through the transport path 42 of the collating apparatus 14. The second transfer sheet 22*b* discharged from the transport path 42 has the image-carrying surface down, is fed to the collating unit 36 by its own weight, and lands on the plastic sheet 38.

As a result, the first transfer sheet 22*a* with the image-carrying surface facing up, the plastic sheet 38, and the second transfer sheet 22*b* with the image-carrying surface facing down are fed to the collating unit 36 by being stacked in that order (alignment step). In this stack, the first transfer sheet 22*a* and the second transfer sheet 22*b* are stacked with the image-carrying surfaces facing each other with the plastic sheet 38 therebetween.

Next, ends of the first transfer sheet 22*a*, the plastic sheet 38, and the second transfer sheet 22*b* in the collating unit 36 are aligned by an alignment device not shown in the drawing. The ends of the stack are provisionary fastened with the provisional fastener 44 and the stack is transported to the lamination apparatus 16. The transfer sheets 22 and the plastic sheet 38 have the same size and the ends of the sheets constituting the stack are evened up to conduct alignment.

Next, in the lamination apparatus 16, the stack constituted by the first transfer sheet 22*a*, the plastic sheet 38, and the second transfer sheet 22*b* is passed through the nip between the pair of belts 46 to conduct thermocompression bonding. As a result, the plastic sheet 38 is thermocompression-bonded with the first transfer sheet 22*a* and the second transfer sheet 22*b* (thermocompression bonding step).

The thermocompression-bonded stack is then transported to the separation apparatus 17.

As the front end of the stack approaches the air ejection nozzle 19, compressed air is ejected from the nozzle. An end of the substrate of the first transfer sheet 22*a* and an end of the substrate of the second transfer sheet 22*b* detaches due to air from the plastic sheet 38 to which the image-receiving layer and the transparent support are press-bonded. The tip of the guide 21*a* enters the region between the substrate and the transparent support of the first transfer sheet 22*a* and the tip of the guide 21*b* enters the region between the substrate and the transparent support of the second transfer sheet 22*b*. As the stack is transported further, the substrates of the two transfer sheets are transferred in a direction that allows the substrate to detach from the plastic sheet 38 along the guides 21*a* and 21*b* and become separated from the plastic sheet 38.

The plastic sheet 38 to which the image-receiving layers and the transparent supports are press-bonded are discharged into receiver 56 and a recorded plastic sheet is obtained. In the case where the plastic sheet has a number of images formed thereon, the plastic sheet is cut for every image to obtain plastic sheets of a particular size.

The substrate with the rear outermost layer of the first transfer sheet 22*a* and the substrate with the rear outermost layer of the second transfer sheet 22*b* pass through paths not shown in the drawing and discharged into a transfer sheet discharge receiver 57.

In sum, according to the system for producing an image recording member according to the exemplary embodiment, an image is formed on one side of each transfer sheet 22 by electrophotography and the two transfer sheets 22 are thermocompression-bonded while having image surfaces facing each other with a plastic sheet 38 therebetween, and the substrates of the transfer sheets 22 are separated to obtain an image recording member.

Moreover, the reversing path 26*a* is provided in the transport path 26 through which the transfer sheet 22 is transported from the image-forming unit 20 of the image-forming apparatus 12 to the discharge port 28. Thus, the first transfer sheet 22*a* to be provided at the lower side in the collating unit 36 is not fed to the reversing path 26*a* but the second transfer sheet 22*b* to be provided at the upper side in the collating unit 36 is passed through the reversing path 26*a* so that the second transfer sheet 22*b* is transported top-side down. Since the sides of the transfer sheets 22 are selectively reversed as such, alignment is performed continuously and printing is conducted on plastic sheets more efficiently.

EXAMPLES

The present invention will now be described in further detail by using Examples which do not limit the scope of the present invention. In Examples and Comparative Examples below, "parts" means "parts by mass" and "%" means "% by mass".

Example 1

An image transfer sheet (transfer sheet a1) for electrophotography is prepared as by the method described below step-by-step.

Preparation of Rear Outermost Layer Coating Solution Aa-1

A rear outermost layer coating solution Aa-1 is prepared by mixing 20 parts of a polyester resin (Follett FF-4M produced by Soken Chemical & Engineering Co., Ltd., solid content: 30%) serving as a thermoplastic resin, 0.5 parts of a cationic surfactant (Elegan 264WAX produced by NOF Corporation), 3.5 parts of sodium oleate (produced by Kanto Chemical Co., Inc.) serving as an alkali metal salt of an aliphatic carboxylic acid, and 200 parts of methyl ethyl ketone and stirring the resulting mixture.

Preparation of Image-Receiving Layer Coating Solution Ba-1

A image-receiving layer coating solution Ba-1 is prepared by adding 10 parts of a polyester resin (Elitel UE3600 produced by Unitika Ltd., Tg: 75° C.) and 11.5 parts of a polyester resin (Elitel UE3223 produced by Unitika Ltd., Tg: 1° C.) as thermoplastic resins, 1 part of a surfactant (Elegan 264WAX produced by NOF Corporation), and 6 parts of spherical particles of crosslinked polybutyl methacrylate (BM30X-12 produced by Sekisui Plastics Co., Ltd., average particle size: 12 μm) serving as a filler to 55 parts of a solvent, which is methyl ethyl ketone, and stirring the resulting mixture.

Preparation of Tacking Layer Coating Solution Ca-1

A tacking layer coating solution Ca-1 is prepared by diluting 20 parts of a silicone tackiness agent (XR37-B9204 produced by GE Toshiba Silicones Co., Ltd., solid content: 60%) and 0.2 parts of a crosslinking agent therefor (XC93-B6144 produced by GE Toshiba Silicones Co., Ltd.) with 20 parts of toluene.

Preparation of Transfer Sheet a1

The tacking layer coating solution Ca-1 is applied to one surface of a biaxially stretched PET (Lumirror S10 produced by Toray Industries Inc., thickness: 75 μm) serving as a substrate by using a wire bar. The applied solution is dried at 120° C. for 2 minutes to form a tacking layer having a thickness of 7 μm.

One surface of a biaxially stretched PET (Lumirror F53 produced by Toray Industries Inc., thickness: 6 μm) is bonded to the tacking layer on the substrate at room temperature (22° C.) at a bonding rate of 0.2 m/min and a cylinder pressure of 588 KPa.

The rear outermost layer coating solution Aa-1 is applied to the other surface (surface with no tacking layer) of the substrate by using a wire bar. The applied solution is dried at 100° C. for 1 minute to form a rear outermost layer 0.1 μm in thickness. The surface resistivity at the rear outermost layer side is $2.5\times10^{10}\Omega/\square$.

Next, the image-receiving layer coating solution Ba-1 is applied to the unprocessed surface (the surface not bonded to the tacking layer) of the transparent support by using a wire bar. The applied solution is dried at 120° C. or 1 minute to form an image-receiving layer 10 μm in thickness. Then the resulting stack is cut into an A4 size (210 mm×297 mm) to prepare a transfer sheet a1. The surface resistivity at the image-receiving layer side is $3.3\times10^{9}\Omega/\square$.

Evaluation of Performance of Transfer Sheet

Evaluation of Transport Property Inside Apparatus

Thirty transfer sheets a1 (image not yet formed) are placed in a sheet tray of an image forming apparatus (color copier DocuColor 1450GA produced by Fuji Xerox Co., Ltd.) at room temperature of 35° C. and humidity of 70% and are left to stand for 24 hours. Then printing is continuously conducted on the thirty transfer sheets a1. Whether jamming caused by the transfer sheets inside the image-forming apparatus occurs and whether multi-feeding (feeding multiple transfer sheets simultaneously) occurs is confirmed. The evaluation standards are as follows. The results are shown in Table.

A: No jamming or multi-feeding occurred.

B: Jamming and/or multi-feeding occurred.

(In Table, the figures next to the ratings for multi-feeding and jamming indicate the numbers of sheets at which the multi-feeding and/or jamming occurred).

Example 2

Preparation of Rear Outermost Layer Coating Solution Aa-2

A rear outermost layer coating solution Aa-2 is prepared by mixing 10 parts of an acryl-based polymer solution (Elecond QO-101 produced by Soken Chemical & Engineering Co., Ltd., solid content: 50%) containing a methacrylate structural unit and a methacrylic acid ester structural unit containing a quaternary ammonium salt with a methyl sulfate ion as a counter anion, 1.7 parts of sodium palmitate (produced by Kanto Chemical Co., Inc.) as an alkali metal salt of an aliphatic carboxylic acid, and 200 parts of a isopropyl alcohol/water (7:3) solution, and stirring the resulting mixture.

Preparation of Image-Receiving Layer Coating Solution Ba-2

An image-receiving layer coating solution Ba-2 is prepared by adding 9 parts of a polyester resin (Vylon 802 produced by Toyobo Co., Ltd., Tg: 60° C.) and 11 parts of a polyester resin (Vylon 500 produced by Toyobo Co., Ltd., Tg: 4° C.) as the thermoplastic resins, 1 part of a surfactant (Elegan 264WAX produced by NOF Corporation), and 3 parts of spherical particles of crosslinked polymethyl methacrylate (SSX-115 produced by Sekisui Plastics Co., Ltd., average particle size: 15 μm) to 50 parts of methyl ethyl ketone as a solvent, and stirring the resulting mixture.

Preparation of Transfer Sheet a2

A transfer sheet a2 is prepared and evaluated as set forth in Example 1 except that the rear outermost layer coating solution Aa-2 is used instead of the rear outermost layer coating solution Aa-1 and the image-receiving layer coating solution Ba-2 is used instead of the image-receiving layer coating solution Ba-1 to form a rear outermost layer (surface resistivity: $2.2\times10^{10}\Omega/\square$) 0.3 μm in thickness and an image-receiving layer (surface resistivity: $1.7\times10^{10}\Omega/\square$) 15 μm in thickness.

The results are shown in Table.

Example 3

Preparation of Rear Outermost Layer Coating Solution Aa-3

A rear outermost layer coating solution Aa-3 is prepared as in Example 2 except that 5 parts of sodium stearate (produced by Wako Pure Chemical Industries, Ltd.) is added instead of 1.7 parts of sodium palmitate (produced by Kanto Chemical Co., Inc.) used to form the rear outermost layer coating solution Aa-2 in Example 2 and that 1 part of cross-linked acryl spherical particles (Techpolymer SSX-101 produced by Sekisui Plastics Co., Ltd., average particle size: 1 μm) are added.

Preparation of Image-Receiving Layer Coating Solution Ba-3

A image-receiving layer coating solution Ba-3 is prepared by adding 8.5 parts of a polyester resin (polyester TP235 produced by Nippon Synthetic Chemical Industry Co., Tg: 65° C.) and 11.5 parts of a polyester resin (polyester LP050 produced by Nippon Synthetic Chemical Industry Co., Tg: 10° C.) as thermoplastic resins, 1.2 parts of a surfactant (Elegan 264WAX produced by NOF Corporation), and 4 parts of spherical particles of crosslinked polymethyl methacrylate (SSX-120 produced by Sekisui Plastics Co., Ltd., average particle size: 20 μm) as a filler to 50 parts of methyl ethyl ketone as a solvent, and stirring the resulting mixture.

Preparation of Transfer Sheet a3

A transfer sheet a3 is prepared as in Example 1 except that the rear outermost layer coating solution Aa-3 is used as the rear outermost layer coating solution Aa-1 and the image-receiving layer coating solution Ba-3 is used instead of the image-receiving layer coating solution Ba-1 to form a rear outermost layer (surface resistivity: $9.5\times10^{9}\Omega/\square$) 0.05 μm in thickness and an image-receiving layer (surface resistivity: $3.5\times10^{9}\Omega/\square$) 15 μm in thickness. Evaluation is conducted as in Example 1.

The results are shown in Table.

Example 4

Preparation of Rear Outermost Layer Coating Solution Aa-4

A rear outermost layer coating solution Aa-4 is prepared by mixing 70 parts of an acryl-based polymer solution (Saftomer ST-3200 produced by Mitsubishi Chemical Corporation, aqueous solution with a solid content of 0.5%) containing a methacrylic acid ester structural unit containing a quaternary ammonium salt in which one acetic acid is added to a nitrogen atom, 0.35 parts of sodium oleate (Kanto Chemical Co., Inc.) as an alkali metal salt of an aliphatic carboxylic acid, 5 parts of crosslinked acryl particles (Advancell K001 produced by Sekisui Chemical Co., Ltd., aqueous solution with a solid content of 20%, average particle size: 0.15 μm), and 100 parts of an isopropyl alcohol/water (7:3) solution, and stirring the resulting mixture.

Preparation of Image-Receiving Layer Coating Solution Ba-4

An image-receiving layer coating solution Ba-4 is prepared by adding 10 parts of a polyester resin (Vylon 885 produced by Toyobo Co., Ltd., Tg: 79° C.) and 33 parts of a urethane-modified polyester resin (Vylon UR-3210 produced by Toyobo Co., Ltd., Tg: −3° C., solid content: 30%) as thermoplastic resins, 1 part of a surfactant (Elegan 264WAX produced by NOF Corporation), and 3.5 parts of crosslinked acrylic spherical particles (Techpolymer SSX-115HXE produced by Sekisui Plastics Co., Ltd., average particle size: 15 μm) to 30 parts of methyl ethyl ketone as a solvent, and stirring the resulting mixture.

Preparation of Transfer Sheet a4

A transfer sheet a4 is prepared as in Example 1 except that the rear outermost layer coating solution Aa-4 is used instead of the rear outermost layer coating solution Aa-1 and the image-receiving layer coating solution Ba-4 is used instead of the image-receiving layer coating solution Ba-1 to form a rear outermost layer (surface resistivity: $2.5\times10^{9}\Omega/\square$) 0.05 μm in thickness and an image-receiving layer (surface resistivity: $5.5\times10^{9}\Omega/\square$) 15 μm in thickness. Evaluation is conducted as in Example 1.

The results are shown in Table.

Example 5

Preparation of Rear Outermost Layer Coating Solution Aa-5

A rear outermost layer coating solution Aa-5 is prepared as in Example 4 except that 0.2 parts of sodium oleate (produced by Kanto Chemical Co., Inc.) and 0.15 parts of sodium laurate (Kanto Chemical Co., Inc.) are added instead of 0.35 parts of sodium oleate (Kanto Chemical Co., Inc.) and that the crosslinked acrylic particles are not added.

Preparation of Transfer Sheet a5

A transfer sheet a5 is prepared as in Example 4 except that the rear outermost layer coating solution Aa-5 is used instead of the rear outermost layer coating solution Aa-4 to form a rear outermost layer (surface resistivity: $9.0\times10^{8}\Omega/\square$) 0.05 μm in thickness. Evaluation is conducted as in Example 1.

The results are shown in Table.

Example 6

Preparation of Transfer Sheet a6

A UV-curable urethane acryl resin (Unidic RC29-124 produced by DIC Corporation, solid content: 60%) serving as a coating layer resin is applied with a wire bar to a surface of a releasing layer formed on one side of a biaxially stretched PET (Pana-Peel SG-2 produced by Panac Corporation, thickness: 100 μm) serving as a substrate. The applied solution is dried at 70° C. for 5 minutes and irradiated with ultraviolet (UV) light (high-pressure mercury lamp, 500 mJ/cm$^2$) to form a coating layer. An image-receiving layer is formed on the coating layer by using the rear outermost layer coating solution Aa-4 used in Example 4 and a rear outermost layer is formed on the other surface (the surface on which the coating layer is not formed) of the substrate by using the image-receiving layer coating solution Ba-4 used in Example 4 so as to form a transfer sheet a6. Evaluation is conducted as in Example 1.

The results are shown in Table.

Comparative Examples 1 to 6

Rear outermost layer coating solutions are respectively prepared by removing the alkali metal salts of aliphatic carboxylic acids from the rear outermost layer coating solutions Aa-1 to Aa-5 used in Examples 1 to 6 and transfer sheets a1' to a6' are respectively prepared as in Examples 1 to 6 except for these rear outermost layer coating solutions. Evaluation is conducted as in Example 1. The results are shown in Table.

TABLE

| | Rear outermost layer | | | Evaluation of transfer sheet | |
|---|---|---|---|---|---|
| | | | | Transport property inside apparatus | |
| | Alkali metal salt of aliphatic carboxylic acid | Crosslinked acryl particles | Polymeric resin | Multi-feeding | Jamming |
| Example 1 | Sodium oleate | None | Polyester resin | A | A |
| Example 2 | Sodium palmitate | None | Acryl polymer containing quaternary ammonium salt in side chain | A | A |
| Example 3 | Sodium stearate | Added | Acryl polymer containing quaternary ammonium salt in side chain | A | A |
| Example 4 | Sodium oleate | Added | Acryl polymer containing quaternary ammonium salt in side chain | A | A |
| Example 5 | Sodium oleate Sodium laurate | None | Acryl polymer containing quaternary ammonium salt in side chain | A | A |
| Example 6 | Sodium oleate | Added | Acryl polymer containing quaternary ammonium salt in side chain | A | A |
| Comparative Example 1 | None | None | Polyester resin | B: 7 | B: 4 |
| Comparative Example 2 | None | None | Acryl polymer containing quaternary ammonium salt in side chain | B: 6 | B: 3 |
| Comparative Example 3 | None | Added | Acryl polymer containing quaternary ammonium salt in side chain | B: 3 | B: 3 |
| Comparative Example 4 | None | Added | Acryl polymer containing quaternary ammonium salt in side chain | B: 1 | B: 2 |
| Comparative Example 5 | None | None | Acryl polymer containing quaternary ammonium salt in side chain | B: 6 | B: 2 |
| Comparative Example 6 | None | Added | Acryl polymer containing quaternary ammonium salt in side chain | B: 1 | B: 3 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image transfer sheet comprising:

an image-receiving layer;

a substrate; and a rear outermost layer containing an alkali metal salt of an aliphatic carboxylic acid, the image-receiving layer, the substrate, and the rear outermost layer being arranged in that order.

2. The image transfer sheet according to claim 1, wherein the rear outermost layer further contains crosslinked acryl-based particles having an average particle size of about 0.1 μm or more and about 3 μm or less.

3. The image transfer sheet according to claim 1, wherein the rear outermost layer further contains an acryl-based polymeric resin that contains a quaternary ammonium salt in a side chain.

* * * * *